US010926537B2

(12) United States Patent
Gardner et al.

(10) Patent No.: US 10,926,537 B2
(45) Date of Patent: Feb. 23, 2021

(54) FLUID BACK PRESSURE SENSING WITH A STRAIN SENSOR

(71) Applicant: HEWLETT-PACKARD DEVELOPMENT COMPANY, L.P., Spring, TX (US)

(72) Inventors: James M Gardner, Corvallis, OR (US); Berkeley Fisher, Corvallis, OR (US); Daryl E Anderson, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/490,842

(22) PCT Filed: Apr. 24, 2017

(86) PCT No.: PCT/US2017/029214

§ 371 (c)(1),
(2) Date: Sep. 3, 2019

(87) PCT Pub. No.: WO2018/199910

PCT Pub. Date: Nov. 1, 2018

(65) Prior Publication Data

US 2020/0122466 A1 Apr. 23, 2020

(51) Int. Cl.
*B41J 2/14* (2006.01)

(52) U.S. Cl.
CPC ..... *B41J 2/14153* (2013.01)

(58) Field of Classification Search
CPC ..... B41J 2/14153
See application file for complete search history.

(56) References Cited

U.S. PATENT DOCUMENTS

| | | | |
|---|---|---|---|
| 4,216,483 | A | 8/1980 | Kyser |
| 6,398,329 | B1 | 6/2002 | Boyd et al. |
| 6,739,199 | B1 | 5/2004 | Nikkel |
| 2002/0130911 | A1 | 9/2002 | Huang et al. |
| 2005/0195248 | A1 | 9/2005 | Nagashima |
| 2006/0244777 | A1 | 11/2006 | Paasch |
| 2007/0040860 | A1 | 2/2007 | Chou et al. |
| 2009/0174751 | A1 | 7/2009 | Miura |
| 2009/0322808 | A1 | 12/2009 | Mitchell et al. |
| 2012/0069092 | A1 | 3/2012 | Muakami et al. |

FOREIGN PATENT DOCUMENTS

| | | | |
|---|---|---|---|
| EP | 1457766 | B1 | 5/2013 |
| EP | 3062080 | A1 | 8/2016 |
| JP | 2000343696 | A | 12/2000 |
| RU | 2144471 | C1 | 1/2000 |
| WO | WO-2010089234 | A1 | 8/2010 |
| WO | WO-2013062517 | A1 | 5/2013 |

OTHER PUBLICATIONS

Kwon, et al. Inkjet Jet Failures and Their Detection Using Piezo Self-sensing. Mar. 3, 2013.

*Primary Examiner* — Sharon Polk
(74) *Attorney, Agent, or Firm* — Rathe Lindenbaum LLP

(57) ABSTRACT

A fluidic die may include a substrate having a flexible region opposite a fluid supply passage within the substrate, a nozzle supported by the substrate proximate the flexible region and a strain sensor on the flexible region of the substrate. The strain sensor may sense strain during flexing of the flexible region to sense fluid back pressure changes.

19 Claims, 5 Drawing Sheets

FLUID BACK PRESSURE SENSING WITH A STRAIN SENSOR

BACKGROUND

Fluid ejection devices may be utilized to selectively eject fluid. During use, the fluid ejection device may experience back pressure. A back pressure that is too high may cause air to enter into nozzles of the fluid ejection device. A back pressure that is too low may result fluid leaking through the nozzle.

Figure 1:
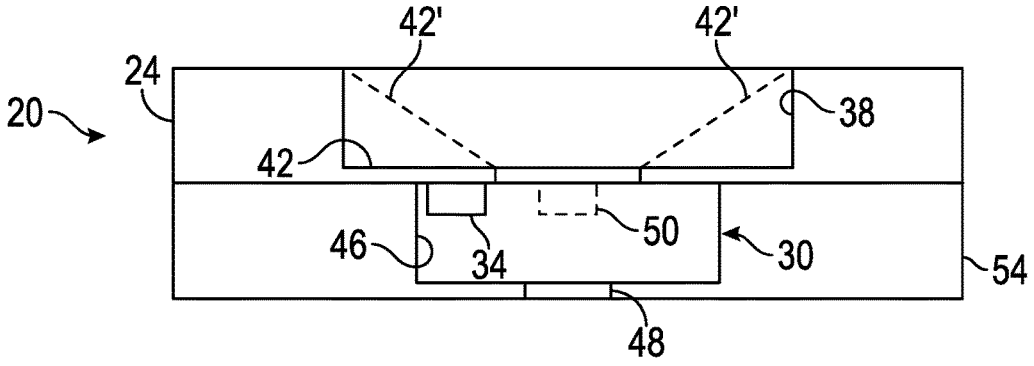
FIG. 1 is a sectional view schematically illustrating portions of an example fluidic die of an example fluid displacement device.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed herein are example fluidic dies and fluid displacement devices that may provide reliable sensing and detection of back pressure. Disclosed herein are example fluidic dies and fluid displacement devices that may measure or sense back pressure directly at a fluid supply passage, such as directly at a fluid supply slot or directly at an ink feed hole, proximate the nozzles. The example fluidic dies and fluid displacement devices utilize a strain gauge or strain sensor mounted to or supported by a flexible region of the substrate in close proximity to a nozzle of the fluidic die. In one implementation, the flexible region thinned such that it is thinner relative to adjacent or surrounding portions of the substrate. In one implementation, the flexible region may have a thickness of less than or equal to 100 μm. The flexing or bending of the flexible region of the substrate is sensed by the strain sensor, wherein signals from the strain sensor cause a pressure of the fluid being supplied through the fluid passage to be adjusted.

Some example fluidic dies comprise microfluidic channels. Microfluidic channels may be formed by performing etching, microfabrication (e.g., photolithography), micromachining processes, or any combination thereof in a substrate of the fluidic die. Some example substrates may include silicon based substrates, glass based substrates, gallium arsenide based substrates, and/or other such suitable types of substrates for microfabricated devices and structures. Accordingly, microfluidic channels, chambers, orifices, and/or other such features may be defined by surfaces fabricated in the substrate of a fluidic die. Furthermore, as used herein a microfluidic channel may correspond to a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.).

Disclosed herein is a fluidic die that comprises a substrate having a flexible region opposite a fluid supply passage within the substrate, a nozzle supported by the substrate proximate the flexible region and a strain sensor on the flexible region of the substrate. The strain sensor may sense strain during flexing of the flexible region to sense fluid back pressure changes.

Disclosed herein is an example fluid displacement device that may comprise a fluid supply, a pressure adjuster to adjust pressure of fluid to be supplied by the fluid supply, a substrate having a flexible region, a nozzle supported by the substrate proximate the flexible region, a fluid supply passage within the substrate to supply fluid from the fluid supply to the nozzle, a strain sensor on the flexible region of the substrate and a controller. The strain sensor may sense strain during flexing of the flexible region to sense fluid back pressure changes. The controller may output control signals to the pressure adjuster to adjust a pressure of the fluid being supplied, wherein the control signals are based upon signals from the strain sensor.

Disclosed herein is an example method for monitoring and controlling back pressure in a fluid displacement device. Pursuant to the method, a strain sensor may be supported on a flexible region of a substrate opposite a fluid supply passage that supplies fluid to a nozzle. Strain of the flexible region is sensed with the strain sensor to sense a fluid back pressure condition. A pressure of the fluid being supplied may be adjusted based upon the determined fluid back pressure condition.

FIG. 1 is a schematic diagram illustrating an example fluidic die 20 that may be utilized as part of an example fluid displacement device. Fluidic die 20 facilitates enhanced monitoring and detection of back pressure conditions proximate a nozzle of the fluidic die. As a result, fluidic die 20 facilitates prompt and appropriate responses to changes in back pressure conditions to reduce or avoid fluid leakage or air ingestion with respect to the nozzle. Fluidic die 20 comprises substrate 24, nozzle 30 and strain sensor 34.

Substrate 24 comprises a layer or body of material or multiple materials that form and at least partially define a fluid supply passage 38. Fluid supply passage 38 extends from a fluid supply (not shown) such as a reservoir or volume of fluid or a connection to a remote reservoir of fluid. Substrate 24 comprises a flexible region 42 that generally extends opposite to the fluid supply passage 38. In one implementation, the flexible region 42 is cantilevered or suspended between fluid supply passage 38 on a first side and a continuous volume that comprises a fluid ejection chamber of nozzle 30 on a second side opposite the first side.

In one implementation, the flexible region is located on an axial end of an elongate slot, wherein nozzles are located along transverse sides of the elongate slot. In one implementation, the flexible region is located at both opposite axial ends of the elongate slot. In another implementation, the flexible region is located along transverse sides of the elongate slot. In yet other implementations, the flexible region forms a floor of a slot or a fluid feed hole, wherein passages extend from the fluid supply passage through the floor to underlying nozzles.

As shown in FIG. 1, in one implementation, the flexible region has a substantially uniform thickness in those portions that are cantilevered. As shown in broken lines in FIG. 1, in other implementations, the flexible region or regions may have a varying thickness in those portions that are cantilevered. For example, in some implementations, the flexible region or regions may be sloped or ramped (as indicated by broken lines 42') so as to have a tapering thickness.

Nozzle 30 comprises an arrangement of components that facilitate the ejection or displacement of fluid. Examples of such fluids include, but are not limited to, a biological solution or liquid containing an analyte to be analyzed, an ink to be printed, a coalescing agent to be dispensed as part of an additive manufacturing process of an additive manufacturing device (a three dimensional printer), and a liquid catalyst to be dispensed.

Nozzle 30 comprises a firing or ejection chamber 46, and orifice 48 and a fluid ejector 50. In the example illustrated, ejection chamber 46 may be formed in a barrier layer 54 or other layer of material joined or coupled to substrate 24. Orifice 48 comprise an opening through which fluid is ejected from ejection chamber 46. In one implementation, orifice 48 may be provided in layer 54. In another implementation, a separate layer or plate providing orifice 48 may be secured to layer 54.

Fluid ejector 50 comprise a fluid actuator that displaces fluid responsive to electrical actuation. Fluid ejector 50 may comprise a piezoelectric membrane based actuator, a thermal resistor based actuator, an electrostatic membrane actuator, a mechanical/impact driven membrane actuator, a magnetostrictive drive actuator or other such elements that may cause displacement of fluid responsive to electrical actuation. In one implementation, fluid ejector 50 is supported and suspended by the flexible region 42 of substrate 24. In one implementation, fluid ejector 50 may be supported along transverse sides of an elongate slot forming the fluid supply passage 38. In another implementation, fluid ejector 50 may be supported by the flexible region that forms a floor of the fluid feed hole.

Strain sensor 34 comprise a strain gauge to sense the strain experienced by an attached structure. In one implementation, strain sensor 34 may comprise a piezoelectric or piezoresistive element, wherein the element may then be implemented as a single ended device, or in a Wheatstone bridge arrangement. In other implementations, strain sensor 34 may comprise other strain sensing devices.

Strain sensor 34 is supported by the flexible region 42 of substrate 24 so as to output signals based upon or corresponding to strain experienced by region 42. In one implementation, strain sensor 34 is formed directly upon or directly mounted to substrate 24. In another implementation, intermediate layers or films of material may be sandwiched between strain sensor 34 and the flexible region 42 of substrate 24. In one implementation, at least a portion of the strain sensor 34 is supported by portions of flexible region 42 that are thinner relative to those portions of substrate 24 that do not extend between the fluid supply passage 38 and the underlying volume that is in connection with ejection chamber 46. In one implementation, flexible region 42 may have a thickness of less than or equal to 700 μm facilitate flexing of such portions of region 42 in response to back pressures. In one implementation, flexible region 42 may have a thickness of less than or equal to 100 μm. In still other implementations, flexible region 42 may have a thickness of less than or equal to 50 μm. The smaller the thickness of flexible region 42, the greater the degree of flexing in response to back pressure and the greater the degree of sensitivity to such back pressures.

In one implementation, strain sensor 34 is supported by a flexible region 42 on an axial end of an elongate slot forming fluid supply passage 32. In one implementation, a strain sensor 34 supported by two flexible regions 42 on opposite axial ends of the elongate slot forming fluid supply passage 32. In yet another implementation, strain sensor 34 is supported by flexible region 42 along transverse sides of the elongate slot forming fluid supply passage 32. In yet another implementation, strain sensor 34 is supported by flexible region 42 spanning or extending across the fluid supply passage 38 so as to form a floor of the fluid supply passage 38, wherein fluid supply opening extends through the floor to the volume in connection with ejection chamber 46.

Figure 2:
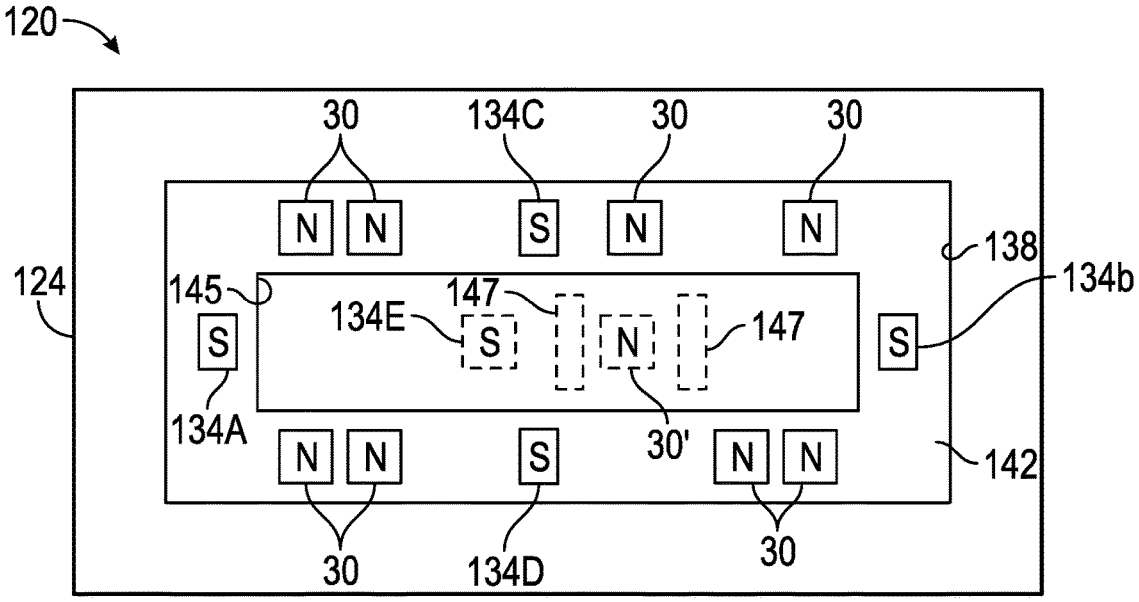
FIG. 2 is a top view schematically illustrating portions of an example fluidic die of an example fluidic displacement device.

FIG. 2 is a block diagram schematically illustrating portions of an example fluidic die 120, illustrating various potential locations for strain sensor 34. Fluidic die 120 comprises substrate 124 and strain sensors 134A, 134B, 134C, 134D and 134E (collectively referred to as strain sensors 134). Fluidic die 124 is similar to fluidic die 24 described above in that fluidic die 124 forms or has formed therein a fluid supply passage 138 supplies fluid to be displaced or ejected to each of the nozzles supported by substrate 124 as part of the fluidic die 120. Fluid supply passage 138 extends above and over the flexible region 142 which itself extends over an underlying cavity or void such that region 142 is cantilevered, being able to flex upwardly and downwardly in response to back pressure changes.

In one implementation, flexible region 142 may extend about the perimeter of an elongate slot opening 145. In such an implementation, sensors 134A and 134B may be supported by the flexible region 142 on the axial ends of slot opening 145, on an underside of region 142, between fluid supply passage 138 and the layer or layers forming the firing chambers 46 (shown in FIG. 1) of nozzles 30. In another implementation, sensors 134C and 134D may be located on the transverse sides of slot opening 145, on an underside of region 142, between fluid supply passage 138 and the layer or layers forming the firing chambers 46 (shown in FIG. 1) of nozzles 30.

As shown by broken lines in FIG. 2, in some implementations, in lieu of slot opening 145, flexible region 142 extends completely across fluid passage 138, forming a floor of fluid passage 138, wherein additional or separate fluid delivery openings 147 extend through the flexible region 142 forming the floor and wherein fluid passes through such openings 147 to the underlying ejection chambers 46 of nozzles 30. Although two rectangular delivery openings 147 are illustrated, it should be appreciated that fluid delivery openings 147 may comprise a single opening or more than two openings, may have other shapes, may have other sizes and may have other locations with respect to nozzle 30' and sensor 134E in the floor a fluid passage 138. In such an implementation, nozzles 30 may be located along the transverse sides of fluid supply passage 138 or may be supported directly beneath the flexible region 142 forming the floor of fluid supply passage 138. In such an implementation, a strain sensor, such as strain sensor 134E may be supported by the portion of the flexible region 142 forming the floor of fluid supply passage 138.

Figure 3:
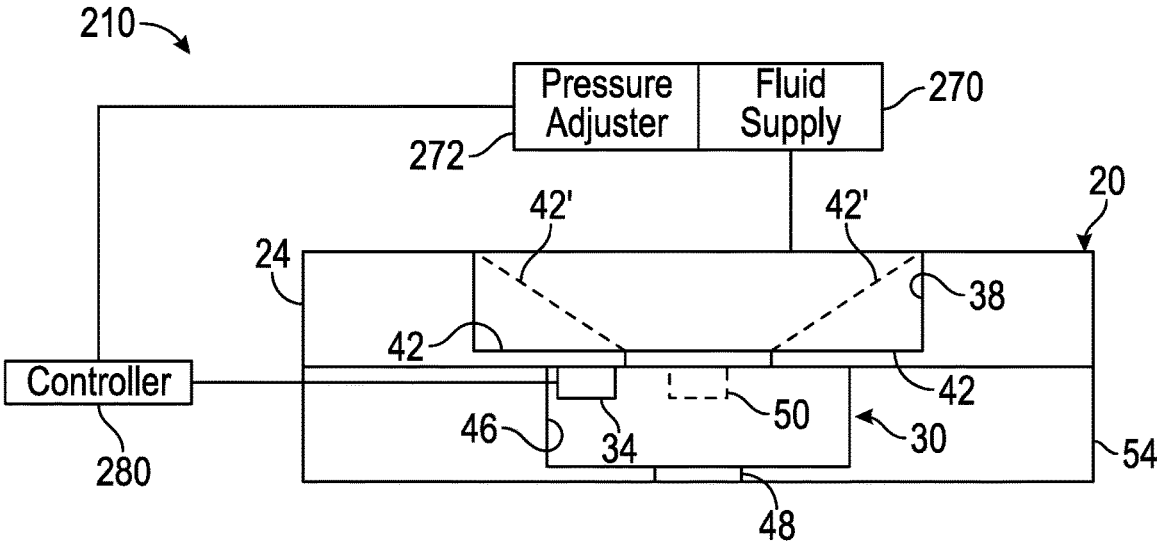
FIG. 3 is a block diagram schematically illustrating portions of an example fluid displacement device.

FIG. 3 is a schematic diagram of an example fluid displacement device 210. Fluid displacement device 210 comprises fluidic die 20 described above and further comprises fluid supply 270, pressure adjuster 272 and controller 280. Fluid supply 270 supplies fluid to fluid supply passage 38. In one implementation, fluid supply 270 comprises a chamber or reservoir for containing the fluid to be displaced or ejected. In another implementation, fluid supply 270 comprises a fluid coupler for being connected to a remote supply of fluid.

Pressure adjuster 272 comprises a device or mechanism that adjusts a pressure of fluid being supplied to and along fluid supply passage 38. In one implementation, pressure adjuster 272 comprises a valve that controls the rate at which fluid is supplied to fluid supply passage 38 from fluid supply 270. In yet another implementation, pressure adjuster 272 comprises an inflator and a bladder or inflatable balloon within a reservoir forming fluid supply 270, wherein inflation or deflation of the bladder adjusts the pressure of the fluid. In yet other implementations, pressure adjuster 272 may comprise other mechanisms for adjusting the pressure the fluid within fluid supply 270 and/or fluid supply passage 38.

Controller 280 receives signals indicating a sensed strain of flexible region 42 of substrate 24. Controller 280 correlates the sensed strain to a back pressure value of the fluid proximate the nozzle 30. In one implementation, a prior calibration correlates the sensed strain to back pressure values of the fluid proximate nozzle 30. Based upon the determined back pressure values proximate to nozzle 30, controller 280 outputs control signals adjusting the operation of pressure adjuster 272 to adjust the back pressure to within a predetermined range, such as a range wherein air does not enter nozzle 30 and wherein nozzle 30 does not experience fluid leakage.

In one implementation, controller 280 comprises a processing unit and associated non-transitory computer readable medium containing instructions that direct the processing unit to output control signals for pressure adjuster 272 based upon signals from strain sensor 30. In another implementation, controller 280 may comprise logic componentry or logic circuitry that automatically outputs control signals to pressure adjuster 272 in response to signals from strain sensor 30. Although device 210 is illustrated as being utilized with fluidic die 20, device 210 may be utilized with fluidic die 120 or any of the fluidic die described hereafter.

Figure 4:
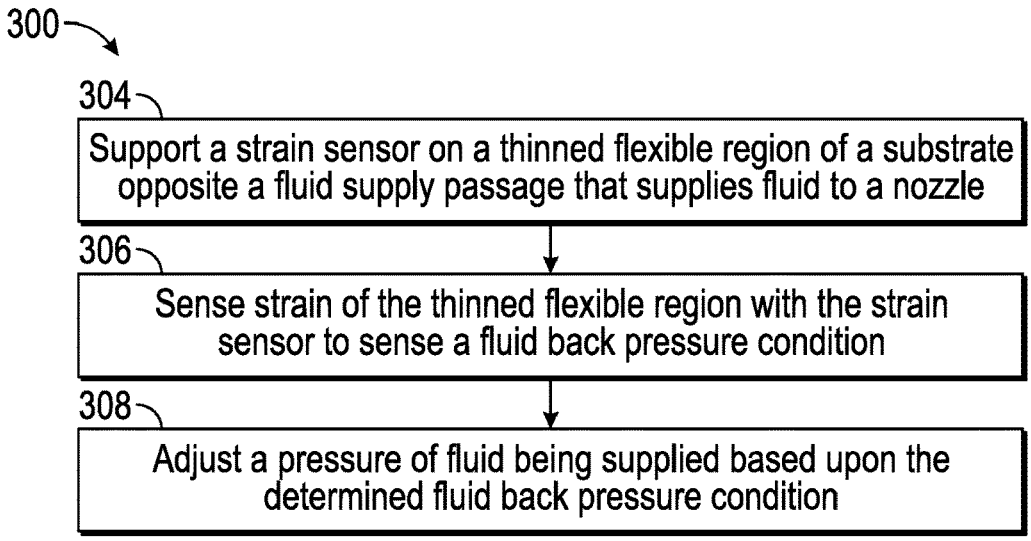
FIG. 4 is a flow diagram of an example method for monitoring and controlling back pressure in a fluid displacement device.

FIG. 4 is a block diagram of an example method 300 for monitoring and controlling back pressure in a fluid displacement device. Although method 300 is described with respect to fluid displacement device 210, it should be appreciated that method 300 may be carried out by other similar fluid displacement devices 210 and other described fluidic dies. As indicated by block 304 a strain sensor 34 is supported on a flexible region 42 of a substrate 24 opposite a fluid supply passage 38 that supplies fluid to a nozzle 30.

As indicated by block 306, strain sensor 34 senses a strain on the flexible region 42 to sense a fluid back pressure condition. Because strain sensor 34 senses fluid back pressure at a location close proximity to nozzle 30 and its orifice 48, the back pressure values determined from the signals from strain sensor 34 may be more useful for adjusting pressure of the fluid being supplied to nozzle 30 so as to better avoid such conditions as air gulping and drooling.

As indicated by block 308, in response to signals from strain sensor 34 which may correspond to a back pressure condition, controller 280 outputs control signals to pressure adjuster 272, adjusting the pressure of the fluid being supplied. In one implementation, controller 280 may alert a person or outside controller of the back pressure condition and recommend adjustment to pressure adjuster 272, awaiting command or selection by the person. In yet other implementations, controller 280 may automatically output control signals adjusting the operation of pressure adjuster to adjust back pressure conditions. In such an implementation, a closed-loop feedback system is provided.

In some implementations, the fluid displacement device may perform macro recirculation, wherein a pump circulates fluid across a back side of the fluid nozzles, between fluid supply passages or across the back of fluid supply passages to provide stirring, cooling or other functions. In such implementations, too high or too low of a flow rate may cause pressure issues that, if not addressed, may cause air ingestion or fluid leakage through the nozzles. In such implementations, in response to signals from strain sensor 34 indicating such a pressure condition, controller 280 may output control signals to pressure adjuster 272 which cause pressure adjuster 272 to adjust the rate at which fluid is pumped or otherwise supplied for such macro circulation.

Figure 5:
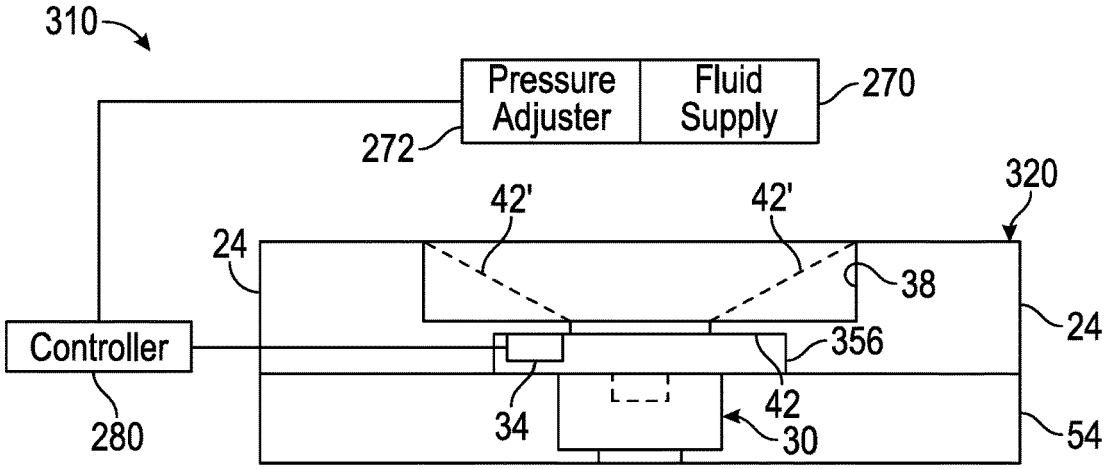
FIG. 5 is a block diagram schematically illustrating portions of another example fluid displacement device.

FIG. 5 schematically illustrates an example fluid displacement device 310 comprising fluidic die 320 as well as fluid supply 270, pressure adjuster 272 and controller 280 illustrated and described above with respect to FIG. 3. Fluidic die 320 is similar to fluidic die 20 described above except that the flexible region 42 of substrate 24 extends over or opposite to a bottom cavity 356 formed in a side of substrate 24 adjacent layer 54 and adjacent nozzle 30. Strain sensor 34 is located on and supported by flexible region 42 within the bottom cavity 356. In one implementation, bottom cavity 356 formed by material removal process, such as etching, for formed from an opposite side of substrate 24 into which fluid supply passage 38 extends.

Figure 6:
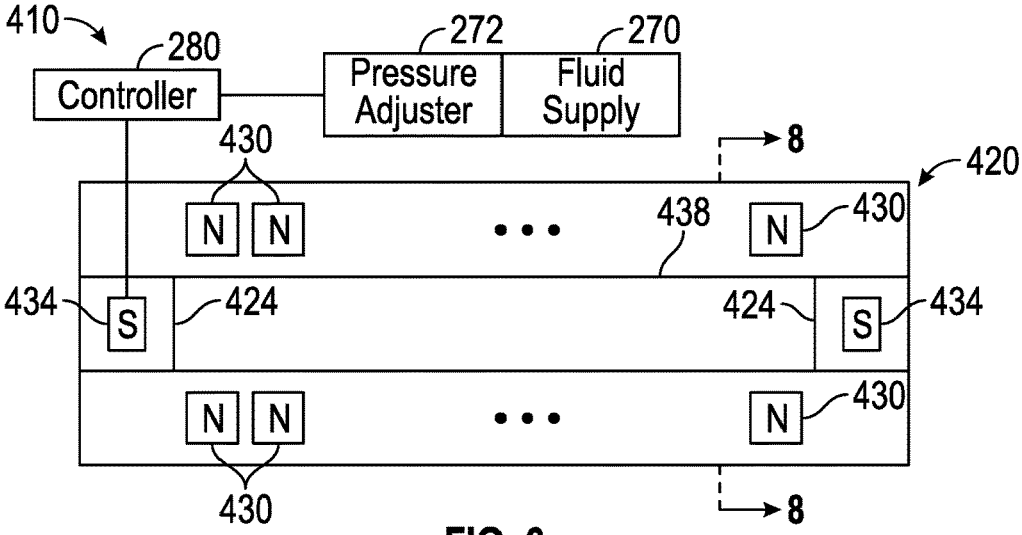
FIG. 6 is a top view schematically illustrating portions of another example fluid displacement device.
Figure 7:
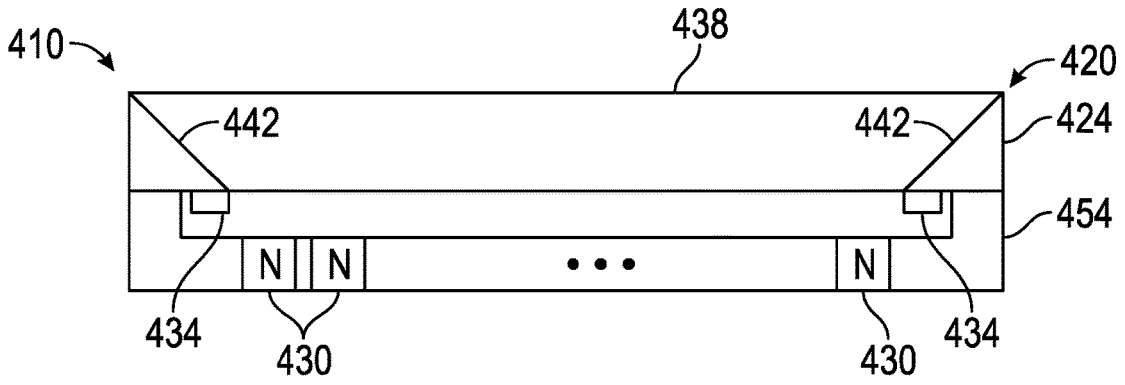
FIG. 7 is a sectional view of portions of the fluid displacement device of FIG. 6.
Figure 8:
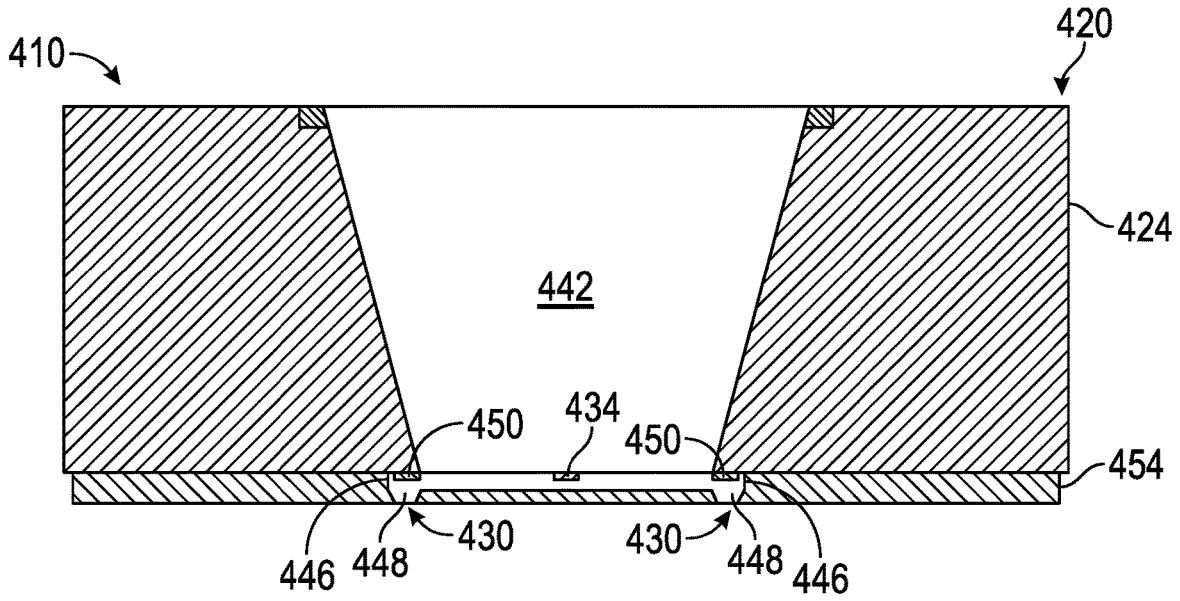
FIG. 8 is an enlarged sectional view of portions of the fluid displacement device of FIG. 6 taken along line 8-8.

FIGS. 6-8 schematically illustrate portions of another example fluid displacement device 410. Fluid displacement device 410 comprises fluidic die 420, fluid supply 270, pressure adjuster 272 and controller 280. Fluidic die 420 comprises substrate 424, nozzles 430 and strain sensors 434.

Substrate 424 comprises a layer or body of material or multiple materials that form and at least partially define a fluid supply passage 438 in the form of a fluid supply slot that extends completely through substrate 424. Fluid supply passage 438 extends from a fluid supply 270 such as a reservoir or volume of fluid or a connection to a remote reservoir of fluid. Substrate 424 comprises flexible regions 442 that generally extend opposite to the fluid supply passage 438. In one implementation, the flexible regions 442 are cantilevered between fluid supply passage 438 on a first side and a continuous volume that comprises a fluid ejection chamber of nozzle 430 on a second side opposite the first side.

In the example illustrated, the flexible region 442 is located on opposite axial ends of the elongate slot of fluid supply passage 438, wherein nozzles 430 are located along transverse sides of the elongate slot. As shown in FIG. 7, in one implementation, the flexible regions have a varying thickness in those portions that are cantilevered. For example, the flexible regions 442 are sloped or ramped so as to form ramped end walls that have a tapering thickness, wherein the thinnest portions of regions 442 are proximate to a longitudinal center of the slot forming fluid supply passage 438.

Each of nozzles 430 comprises an arrangement of components that facilitate the ejection or displacement of fluid. Examples of such fluids include, but are not limited to, a biological solution or liquid containing an analyte to be analyzed, an ink to be printed, a coalescing agent to be dispensed as part of an additive manufacturing process of an additive manufacturing device (a three dimensional printer), and a liquid catalyst to be dispensed.

As shown by FIG. 8, each of nozzles 430 comprises a firing or ejection chamber 446, an orifice 448 and a fluid ejector 450. In the example illustrated, ejection chamber 46 may be formed in a barrier layer 454 or other layer of material joined or coupled to substrate 424. Orifice 448 comprises an opening through which fluid is ejected from ejection chamber 446. In one implementation, orifice 448 may be provided in layer 454. In another implementation, a separate layer or plate providing orifice 448 may be secured to layer 454.

Fluid ejector 450 comprise a fluid actuator that displaces fluid responsive to electrical actuation. Fluid ejector 450 may comprise a piezoelectric membrane based actuator, a thermal resistor actuator, an electrostatic membrane actuator, a mechanical/impact driven membrane actuator, a magnetostrictive drive actuator or other such elements that may cause displacement of fluid responsive to electrical actuation. In the example illustrated, fluid ejector 450 is supported along transverse sides of an elongate slot forming the fluid supply passage 438. In one implementation, fluid ejector 450 may be part of a layer or film deposited or secured to substrate 424 and having electrical traces or wires facilitating communication with fluid ejector 450.

Strain sensor 434 comprise a strain gauge to sense the strain experienced by an attached structure. In one implementation, strain sensor 434 may comprise a Wheatstone bridge. In other implementations, strain sensor 434 may comprise other strain sensing devices.

Strain sensor 434 is supported by the flexible region 442 of substrate 424 so as to output signals based upon or corresponding to strain experienced by region 42. In the example illustrated, strain sensors 34 are supported by flexible regions 442 on opposite axial ends of an elongate slot forming fluid supply passage 438. In one implementation, strain sensor 434 is formed directly upon or directly mounted to substrate 424. In another implementation, intermediate layers or films of material, having electrically conductive wires or traces facilitating communication with sensor 450, may be sandwiched between strain sensor 434 and the flexible region 442 of substrate 424.

In one implementation, at least a portion of the strain sensor 434 is supported by portions of flexible region 442 that are thinner relative to those adjacent or surrounding portions of substrate 424 that do not extend between the fluid supply passage 438 and the underlying volume that is in connection with ejection chamber 446. In one implementation, flexible region 442 may have a thickness of less than or equal to 700 μm facilitate flexing of such portions of region 442 in response to back pressures. In one implementation, flexible region 442 may have a thickness of less than or equal to 100 μm. In still other implementations, flexible region 42 may have a thickness of less than or equal to 50 μm. The smaller the thickness of flexible region 442, the greater the degree of flexing in response to back pressure and the greater the degree of sensitivity to such back pressures.

Fluid displacement device 410 may operate in a fashion similar to the displacement device 210 described above. In one implementation, controller 280 receives signals indicating a sensed strain of flexible region 442 of substrate 424. Controller 280 correlates the sensed strain to a back pressure value of the fluid proximate the nozzle 430. In one implementation, a prior calibration correlates the sensed strain to back pressure values of the fluid proximate nozzle 430. Based upon the determined back pressure values proximate to nozzle 430, controller 280 outputs control signals adjusting the operation of pressure adjuster 272 to adjust the back pressure to within a predetermined range, such as a range wherein air does not gulp into nozzle 430 and wherein nozzle 430 does not experience drooling.

FIGS. 9-12 schematically illustrate another example fluid displacement device 510. Fluid displacement device 510 comprises fluidic die 520, fluid supply 270, pressure adjuster 272 and controller 280. Fluidic die 520 comprises substrate 524, nozzles 530 and strain sensors 534.

Substrate 524 comprises a layer or body of material or multiple materials that form and at least partially define a fluid supply passages 538 in the form of a fluid supply feed holes that comprise blind holes extending into substrate 524 and terminating along a floor provided by flexible regions 542. Fluid supply passage 538 extends from a fluid supply 270 (shown in FIG. 12) such as a reservoir or volume of fluid or a connection to a remote reservoir of fluid. Substrate 524 comprises flexible regions 542 that generally extend opposite to the fluid supply passage 538 and that are sandwiched between fluid supply passage 538 on a first side and a continuous volume that comprises a fluid ejection chamber of nozzle 530 on a second side opposite the first side. In the example illustrated, the flexible region 542 forms a floor of the associated fluid feed whole forming the fluid supply passage 538.

Each flexible region 542 extends completely across its respective fluid passage 538, forming a floor of fluid passage 538, wherein additional or separate fluid delivery openings 547 extend through the flexible region 542 forming the floor and wherein fluid passes through such openings 547 to the underlying ejection chambers 546 of nozzles 530. Although four rectangular delivery openings 547 are illustrated, it should be appreciated that fluid delivery openings 547 may comprise a larger or smaller number of such openings, may have other shapes, may have other sizes and may have other locations with respect to nozzles 530 and sensor 534 in the floor a fluid passage 538. In the example illustrated, nozzles 530 are located and supported directly beneath the flexible region 542 forming the floor of fluid supply passage 538.

Each of nozzles 530 comprises an arrangement of components that facilitate the ejection or displacement of fluid. Examples of such fluids include, but are not limited to, a biological solution or liquid containing an analyte to be analyzed, an ink to be printed, a coalescing agent to be dispensed as part of an additive manufacturing process of an additive manufacturing device (a three dimensional printer), and a liquid catalyst to be dispensed.

Figure 9:
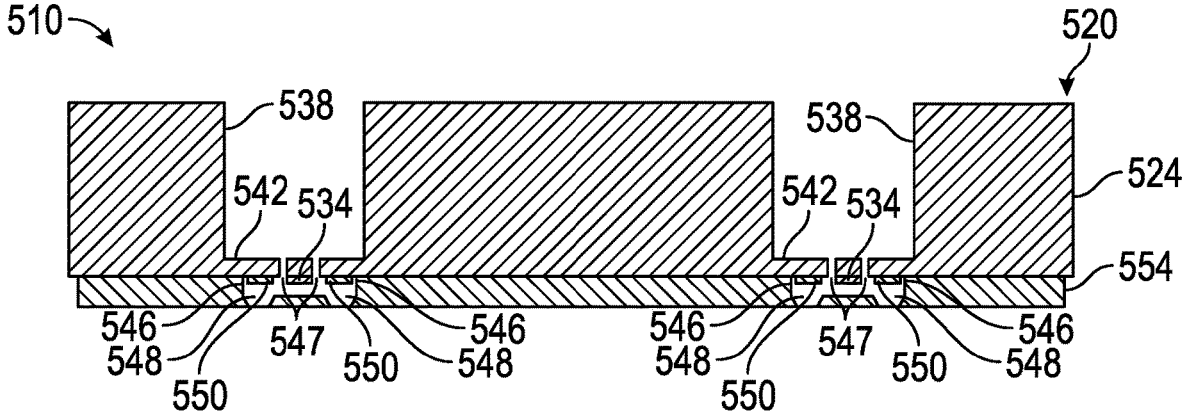
FIG. 9 is a sectional view of another example fluid displacement device.
Figure 10:
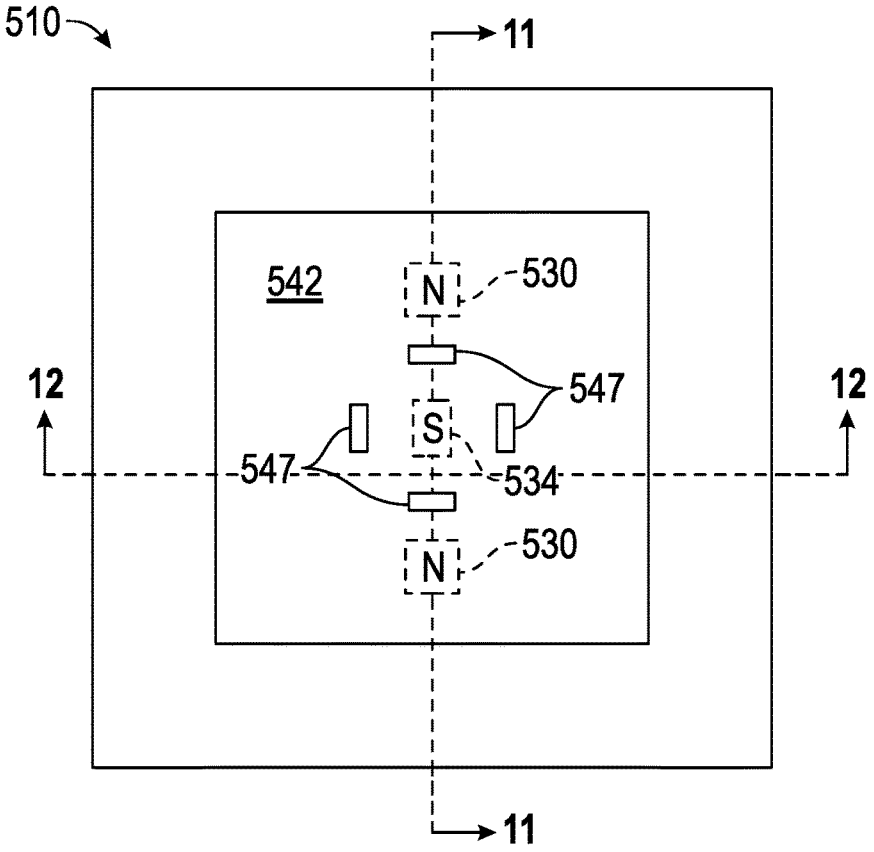
FIG. 10 is an enlarged top view of a portion of the fluid displacement device of FIG. 9.
Figure 11:
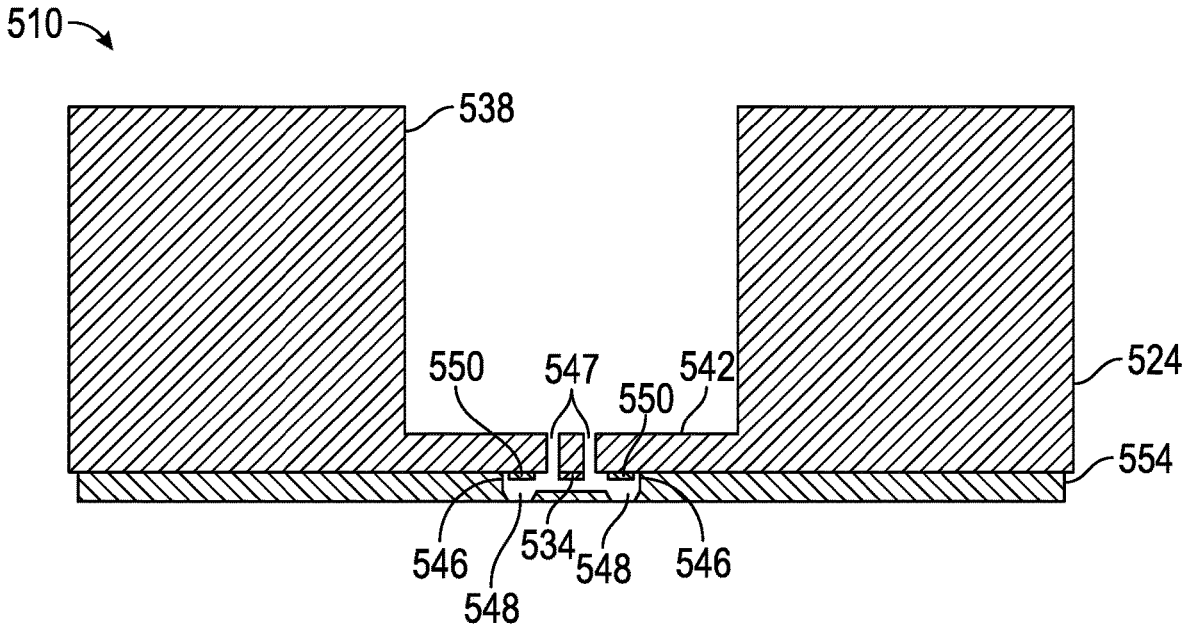
FIG. 11 is an enlarged sectional view of the fluid displacement device of FIG. 10 taken along line 11-11.
Figure 12:
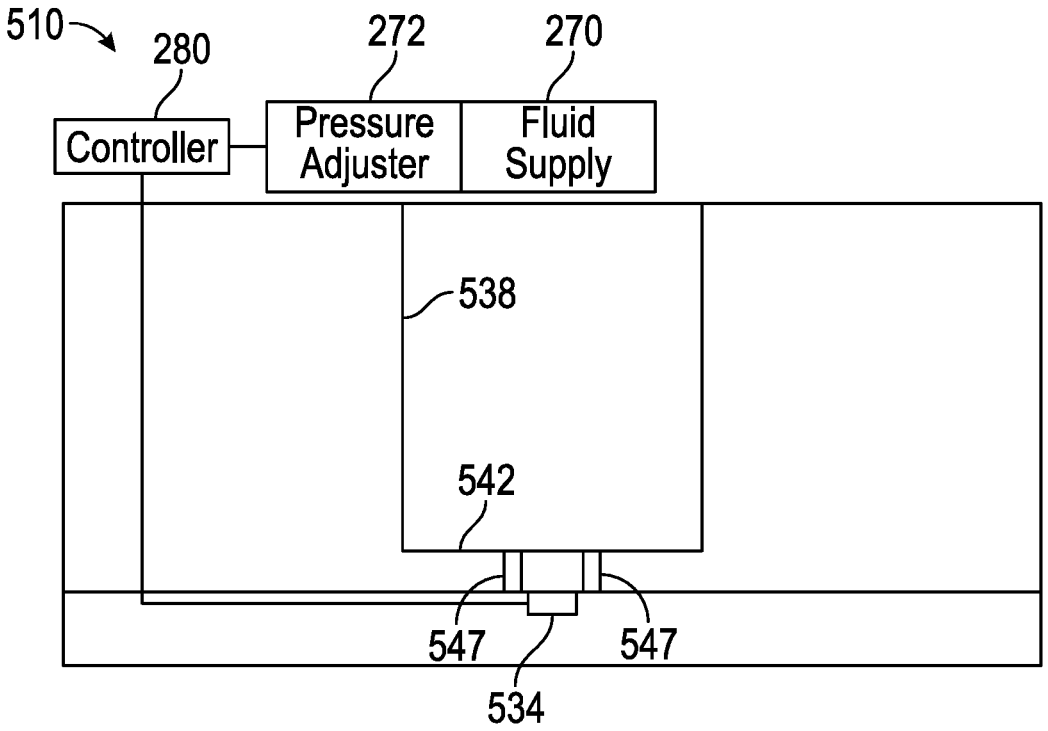
FIG. 12 is an enlarged sectional view of the fluid displacement device of FIG. 10 taken along line 12-12.

As shown by FIGS. 9 and 11, each of nozzles 530 comprises a firing or ejection chamber 546, an orifice 548 and a fluid ejector 550. In the example illustrated, ejection chamber 546 may be formed in a barrier layer 554 or other layer of material joined or coupled to substrate 524. Orifice 548 comprises an opening through which fluid is ejected from ejection chamber 546. In one implementation, orifice 548 may be provided in layer 554. In another implementation, a separate layer or plate providing orifice 548 may be secured to layer 554.

Fluid ejector 550 comprise a fluid actuator that displaces fluid responsive to electrical actuation. Fluid ejector 550 may comprise a piezoelectric membrane based actuator, a thermal resistor based actuator, an electrostatic membrane actuator, a mechanical/impact driven membrane actuator, a magnetostrictive drive actuator or other such elements that may cause displacement of fluid responsive to electrical actuation. In the example illustrated, fluid ejector 550 is supported by flexible region 542 of substrate 524, between substrate 524 and layer 554. In one implementation, fluid ejector 550 is supported directly on substrate 524, below flexible region 542. In another implementation, fluid ejector 550 is supported on or provided as part of a thin film or layer joined to substrate 524 and extending beneath flexible region 542.

Strain sensor 534 comprise a strain gauge to sense the strain experienced by an attached structure. In one implementation, strain sensor 534 may comprise a Wheatstone bridge. In other implementations, strain sensor 534 may comprise other strain sensing devices.

Strain sensor 534 is supported by the flexible region 542 of substrate 524 so as to output signals based upon or corresponding to strain experienced by region 542. In the example illustrated, strain sensors 534 are supported by flexible region 542 opposite to the fluid feed holes forming fluid supply passages 538. In one implementation, strain sensor 534 is formed directly upon or directly mounted to substrate 524. In another implementation, intermediate layers or films of material, having electrically conductive wires or traces facilitating communication with sensor 534, may be sandwiched between strain sensor 534 and the flexible region 542 of substrate 524.

In one implementation, at least a portion of the strain sensor 534 is supported by portions of flexible region 542 that are thinner relative to those portions of substrate 524 that do not extend between the fluid supply passage 538 and the underlying volume that is in connection with ejection chamber 546. In one implementation, flexible region 542 may have a thickness of less than or equal to 700 μm facilitate flexing of such portions of region 542 in response to back pressures. In one implementation, flexible region 542 may have a thickness of less than or equal to 100 μm. In still other implementations, flexible region 542 may have a thickness of less than or equal to 50 μm. The smaller the thickness of flexible region 542, the greater the degree of flexing in response to back pressure and the greater the degree of sensitivity to such back pressures.

Fluid displacement device 510 may operate in a fashion similar to the displacement device 210 described above. In one implementation, controller 280 receives signals indicating a sensed strain of flexible region 542 of substrate 524. Controller 280 correlates the sensed strain to a back pressure value of the fluid proximate the nozzle 530. In one implementation, a prior calibration correlates the sensed strain to back pressure values of the fluid proximate nozzle 530. Based upon the determined back pressure values proximate to nozzle 530, controller 280 outputs control signals adjusting the operation of pressure adjuster 272 to adjust the back pressure to within a predetermined range, such as a range wherein air does not gulp into nozzle 530 and wherein nozzle 530 does not experience drooling.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A fluidic die comprising:

a substrate having a thin flexible region opposite a fluid supply passage within the substrate;

a nozzle supported by the substrate proximate the flexible region; and a strain sensor on the flexible region of the substrate, the strain sensor to sense strain during flexing of the flexible region to sense fluid back pressure changes, wherein the fluid supply passage comprises an elongate slot through the substrate and a ramped end wall that forms the flexible region and wherein the strain sensor is located beneath the ramped end wall.

2. The fluidic die of claim 1, wherein the fluid supply passage comprise a second ramped end wall forming a second flexible region, the fluidic die further comprising a second strain sensor on the second flexible region to sense strain during flexing of the second flexible region in response to back pressure changes.

3. The fluidic die of claim 1 comprising an array of nozzles extending along the elongate slot.

4. The fluidic die of claim 1, wherein the fluid supply passage comprises:

an elongate slot extending into the substrate, the flexible region forming a floor of the slot; and a fluid feed passage extending from the slot through the floor to the nozzle, wherein the strain sensor is supported on a side of the flexible region opposite the floor.

5. The fluidic die of claim 4 further comprising a second strain sensor on the flexible region of the substrate opposite the floor, the second strain sensor to sense strain during flexing of the flexible region in response to fluid back pressure changes.

6. The fluidic die of claim 5 comprising a layer supported by the substrate and forming the firing chamber, the layer forming a fluidic volume adjacent the strain sensor to receive fluid from the fluid supply passage.

7. The fluidic die of claim 4 further comprising a second strain sensor on the flexible region of the substrate opposite the floor, the second strain sensor to sense strain during flexing of the flexible region in response to fluid back pressure changes.

8. The fluidic die of claim 7, wherein the strain sensor is coplanar with the first and second fluid ejectors.

9. The fluidic die of claim 1, wherein the nozzle comprises a firing chamber, an orifice and a fluid ejector within the chamber to displace fluid through the orifice.

10. The fluidic die of claim 1, wherein the flexible region comprise a region of the substrate cantilevered with respect to the slot.

11. A fluid displacement device comprising:

a fluid supply;

a pressure adjuster to adjust pressure of fluid to be supplied by the fluid supply;

a substrate having a flexible region;

a nozzle supported by the substrate proximate the flexible region;

a fluid supply passage within the substrate to supply fluid from the fluid supply to the nozzle;

a strain sensor on the flexible region of the substrate, the strain sensor to sense strain during flexing of the flexible region to sense fluid back pressure changes; and a controller outputting control signals to the pressure adjuster to adjust a pressure of the fluid being supplied based upon signals from the strain sensor.

12. The fluid ejection device of claim 11, wherein the fluid supply passage comprises an elongate slot through the substrate and a ramped end wall that forms the flexible region and wherein the strain sensor is located beneath the ramped end wall.

13. The fluidic ejection device of claim 12, wherein the fluid supply passage comprises a second ramped end wall forming a second flexible region, the fluidic die further comprising a second strain sensor on the second flexible region to sense strain during flexing of the second flexible region in response to back pressure changes.

14. The fluidic ejection device of claim 11, wherein the fluid supply passage comprises:

an elongate slot extending into the substrate, the flexible region forming a floor of the slot; and a fluid supply passage extending from the slot through the floor to the nozzle, wherein the strain sensor is supported on a side of the flexible region opposite the floor.

15. A fluidic die comprising:

a substrate having a thin flexible region opposite a fluid supply passage within the substrate;

a nozzle supported by the substrate proximate the flexible region; and a strain sensor on the flexible region of the substrate, the strain sensor to sense strain during flexing of the flexible region to sense fluid back pressure changes, wherein the fluid supply passage comprises:

an elongate slot extending into the substrate, the flexible region forming a floor of the slot; and a fluid feed passage extending from the slot through the floor to the nozzle, wherein the strain sensor is supported on a side of the flexible region opposite the floor.

16. The fluidic die of claim 15 further comprising a second fluid feed passage extending from the slot through the floor to the nozzle, wherein the strain sensor is between the fluid feed passage and the second fluid feed passage.

17. The fluidic die of claim 16, where the nozzle comprises an ejection chamber underlying the fluid feed passage, the second fluid feed passage, and the strain sensor.

18. The fluidic die of claim 15 further comprising a second nozzle, wherein the nozzle and the second nozzle comprise first and second fluid ejectors, respectively, and wherein the strain sensor is between the first and second fluid ejectors.

19. The fluidic die of claim 15 further comprising:

a second fluid feed passage extending through the floor on an opposite side of strain sensor as the fluid feed passage;

a third fluid feed passage extending through the floor; and a fourth fluid feed passage extending through the floor on opposite side of the strain sensor as the third fluid feed passage.

* * * * *